United States Patent [19]

Moore et al.

[11] 4,148,240

[45] Apr. 10, 1979

[54] PERCUSSION SIMULATING TECHNIQUES

[75] Inventors: Douglas R. Moore, Vernon Hills; Alberto Kniepkamp, Arlington Heights, both of Ill.

[73] Assignee: Norlin Industries, Inc., Lincolnwood, Ill.

[21] Appl. No.: 824,933

[22] Filed: Aug. 15, 1977

[51] Int. Cl.[2] ..... G10H 1/02; G10H 5/02

[52] U.S. Cl. ..... 84/1.22; 74/1.26; 84/DIG. 12

[58] Field of Search ..... 84/1.13, 1.22, 1.24, 84/1.26, DIG. 12

[56] References Cited

U.S. PATENT DOCUMENTS

| | | | |
|---|---|---|---|
| 3,571,481 | 3/1971 | Adachi | 84/1.13 |
| 3,582,530 | 6/1971 | Adachi | 84/1.26 |
| 3,739,071 | 6/1973 | Niinomi | 84/1.22 X |
| 3,809,791 | 5/1974 | Uchiyama | 84/1.26 X |
| 3,825,668 | 7/1974 | Okamoto | 84/1.13 X |
| 3,937,115 | 2/1976 | Staley | 84/1.13 X |

*Primary Examiner*—Stanley J. Witkowski

*Attorney, Agent, or Firm*—Allegretti, Newitt, Witcoff & McAndrews

[57] ABSTRACT

The disclosure describes an improved electronic musical instrument capable of simulating a sound resulting from the striking of a natural percussion instrument. The electronic instrument includes playable keys, a tone signal generator for generating tone signals and an output circuit for converting the tone signals to audible tones. A control circuit responsive to the depression of any one of the keys enables one or more of the tone signals representing one or more fundamental pitches to be transmitted to the output circuit for a first time period and enables another tone signal representing a pitch nonharmonically related to the fundamental pitches to be transmitted to the output circuit for a second time period less than the first time period. By combining the tone signals corresponding to the fundamental and nonharmonic pitches, the sound of a percussion instrument is simulated.

17 Claims, 7 Drawing Figures

PERCUSSION SIMULATING TECHNIQUES

BACKGROUND OF THE INVENTION

1. Field of the Invention

This invention relates to electronic musical instruments, and more particularly relates to such instruments capable of simulating the sound resulting from striking a natural percussion instrument.

2. Description of the Prior Art

The general nature of the harmonic spectrum of natural percussion instruments, such as a xylophone, bars, bells or chimes, has been known for some time. After a short transient or strike time period resulting from striking a percussion instrument has passed, the instrument generally emits a sustaining tone (which gradually decays) having a fundamental pitch or frequency component, together with harmonic frequency components. However, during the strike time period immediately after the instrument is struck, complex sound waves (i.e., strike tones) having complex frequency spectra are generated. In general, these complex strike tones are nonharmonic; that is, they are not integer multiples of the fundamental frequency produced by the sustaining tone of the instrument.

The electronic musical instrument industry has long sought economical techniques for simulating the sound waves produced by natural percussion instruments, especially the complex transient strike tone produced by the striking of the instruments. However, the strike tones are so complex that no economical way of simulating them has been discovered. Complex and costly electronic devices for simulating percussive sounds have been proposed in the past. For example, in a paper entitled, "The Synthesis of Audio Spectra by Means of Frequency Modulation," published in the Journal of the Audio Engineering Society, Volume 27, Number 7, dated Sep. 7, 1973, John Chowning proposes that percussive sounds, such as bells and chimes, can be simulated by frequency modulation circuitry. However, this technique requires complicated frequency modulation equipment, including means for modulating the index of modulation. The frequency modulation equipment is required by Chowning in order to produce the nonharmonic pitches required to simulate the strike tone of a natural percussion instrument.

SUMMARY OF THE INVENTION

The inventors have discovered a startling psychoacoustic phenomenon; namely, that a plurality of the strike tones of a percussion instrument capable of emitting sustaining tones with different fundamental frequencies or pitches (e.g., a set of bells or xylophone) can be simulated by a single strike tone which is nonharmonically related to the fundamental pitches (i.e., is not an integer multiple of the fundamental pitches). It is especially effective to generate a single strike tone for use with a series of sustaining tones having fundamental pitches which are displaced by octaves. Even though only a single strike tone is used, the human ear finds it a suitable representation of all of the strike tones normally associated with the octave-displaced sustaining tones.

It also has been discovered that a percussion instrument can be adequately simulated if the strike tone is displaced by one chromatic semitone from an integer multiple of the fundamental pitch of a sustaining tone of the instrument being simulated. This technique is especially effective if the integer multiple is an integer power of 2 (e.g., $2^0$, $2^1$, $2^2$, $2^3$, etc.)

By using these discoveries, the inventors have been able to produce an electronic musical instrument capable of inexpensively and accurately simulating a natural percussion instrument with a degree of realism heretofore only attainable by much more complicated means. Moreover, by using these discoveries, percussion instruments can be simulated by using the same tone generator and keyer circuits to produce tone signals representing both fundamental sustaining tones and strike tones. This feature substantially reduces the circuitry required to achieve adequate simulation.

Accordingly, it is a basic object of the present invention to provide improved apparatus and methods for simulating the sound of a natural percussion instrument.

It is another object of the invention to provide an instrument of the foregoing type in which a single tone signal can be used to simulate the strike tone associated with a plurality of sustaining tones.

Yet another object of the invention is to provide an instrument of the foregoing type in which a single tone generator signal can be used to provide both a strike tone signal and a sustaining tone signal.

Still another object of the invention is to provide an instrument of the foregoing type in which keyer circuits associated with sustaining tone signals can also be used to key and transmit strike tone signals to an output circuit.

Yet another object of the invention is to provide an instrument of the foregoing type in which the timing for the strike tone signals is digitally derived and is independent of other controls required for sustaining tone signals.

DESCRIPTION OF THE DRAWINGS

These and other objects, advantages and features of the present invention will hereafter appear for purposes of illustration, but not of limitation, in connection with the accompanying drawings, wherein like numbers refer to like parts throughout, and wherein.

DESCRIPTION OF THE PREFERRED EMBODIMENT

Figure 1:
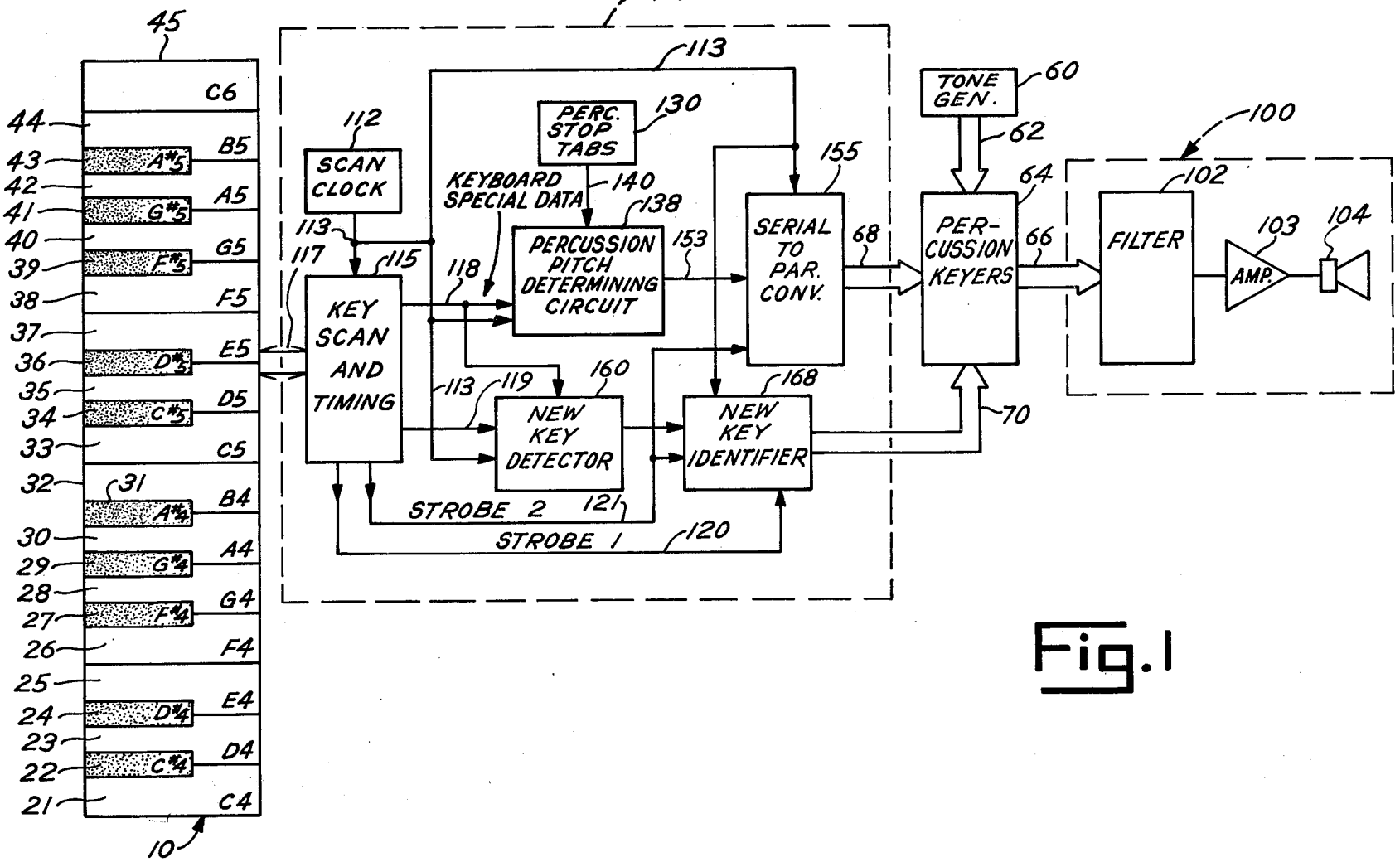
FIG. 1 is a schematic block diagram of a preferred form of electronic musical instrument capable of simulating percussion instruments and made in accordance with the present invention.

Referring to the drawings, a preferred form of the present invention basically comprises a keyboard 10, a tone signal generator 60, a percussion keyer module 64, an output circuit 100 and a control circuit 110.

Referring to FIG. 1, keyboard 10 comprises keys 21–45 arranged in the form of a conventional piano or electronic organ keyboard. The pitch produced when the keys are played through an 8-foot coupler stop tab is identified on the keys in FIG. 1. For example, when played through an 8-foot coupler stop tab, the depression of key 21 results in a fundamental pitch C4 (256 or $2^8$ Hz.), the depression of key 33 results in a fundamental pitch C5 (512 or $2^9$ Hz.), and the depression of key 45 results in a fundamental pitch C6 (1,024 or $2^{10}$ Hz.). The depression of any one of the keys also can represent other pitches depending on the stop tabs which are in operation.

Tone generator 60 transmits a group of electrical tone signals representing different fundamental notes or pitches over a multi-conductor bus 62 to percussion keyer module 64 which comprises a group of individual keyer circuits. Tone generator 60 preferably comprises a top octave synthesizer which generates rectangular pulses at repetition rates corresponding to the pitches of the 12 semitones of the musical chromatic scale within the highest pitched octave to be played by the instrument. The twelve tone signals produced for the highest octave are divided by a series of digital divider circuits to produce the tone signals for all the lower octaves. Such a top octave synthesizer and divider technique is well known in the art and need not be described in detail.

Output bus 62 includes a separate conductor for each of the tone signals which must be produced in response to the playing of any of the keys on keyboard 10. Each of the tone signals corresponds to a different pitch or note. The conductors are each connected to a different individual keyer circuit within keyer module 64.

Each individual keyer circuit within a module 64 corresponds to a different tone signal or pitch to be produced by the instrument.

Figure 2:
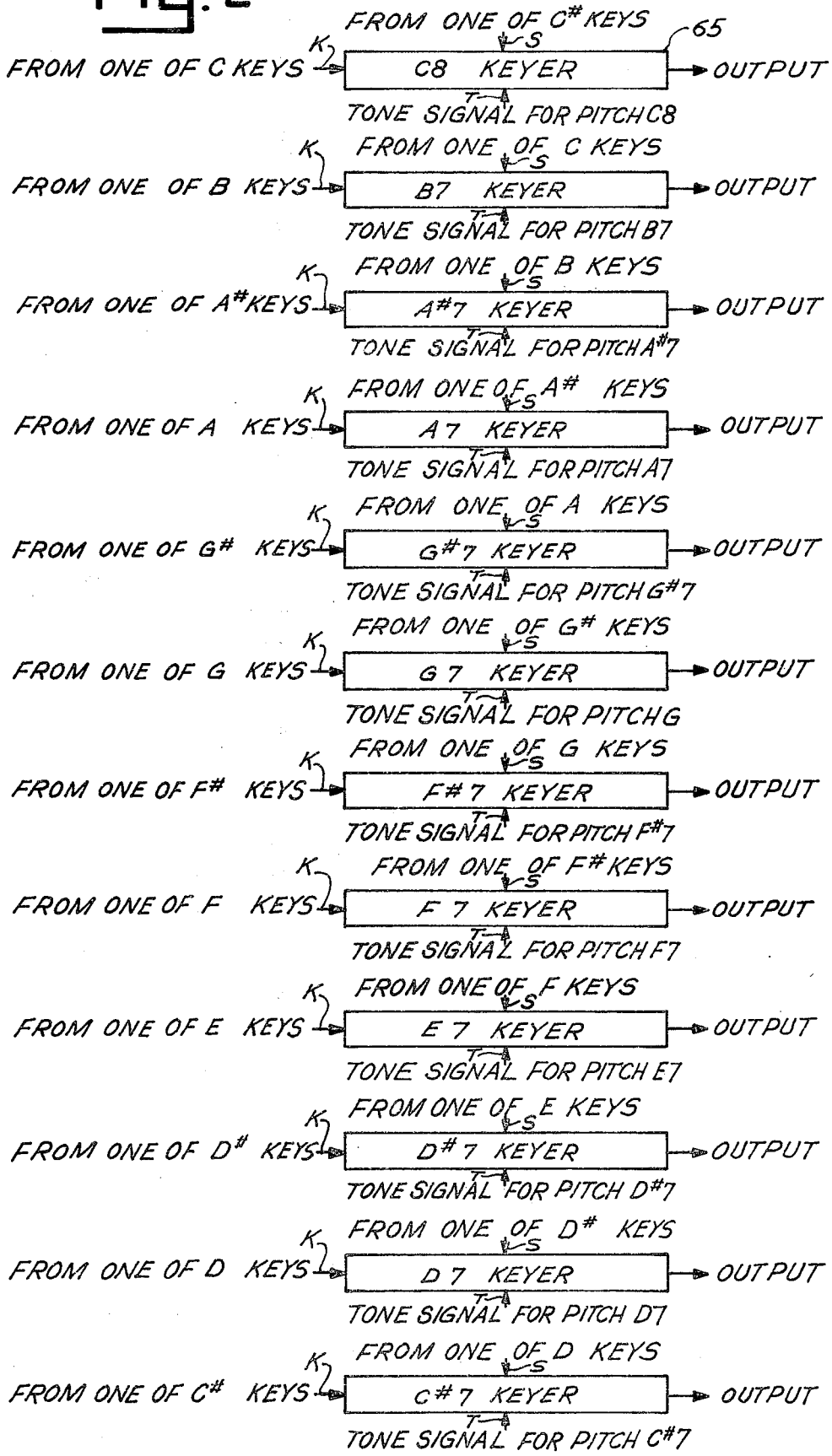
FIG. 2 is a schematic block diagram of a preferred arrangement of keyer circuits used to transmit tone signals representing both sustaining tones and strike tones.

As previously explained, in order to simulate the sound of a natural percussion instrument, such as a bell, an electronic musical instrument must produce a fundamental sustaining tone having a fundamental pitch which represents the sound of the percussion instrument after the transients have died away, and a strike tone having a pitch nonharmonically related to the fundamental pitch which represents the complex transient sound of the percussion instrument when it is initially struck. It has been discovered that this simulation can be achieved by using only a single strike tone for a plurality of different octavely-related sustaining tones. According to the preferred embodiment, this result can be achieved by arranging the twelve individual keyer circuits used in connection with the twelve tone signals representing the twelve semitones of the top octave produced by the instrument (i.e., C#7-C8) as shown in FIG. 2. Each of these keyer circuits is used to transmit a tone signal corresponding to a sustaining tone having a fundamental pitch or corresponding to a strike tone having a nonharmonically related pitch.

Each of the top twelve keyer circuits has an input T which receives a tone signal from generator 60 having a repetition rate corresponding to a predetermined pitch of the chromatic scale. Each such keyer circuit has an input K which receives a +22 volt logical one signal in response to the depression of one or more of the keys representing a sustaining tone to be produced by the instrument. In response to the keyer signal, the tone signal is transmitted through the output of the keyer circuit to output circuit 100. For example, assuming the proper stop tab is operated so that key 45 represents a sustaining tone having pitch C8, the depression of key 45 causes the tone signal representing fundamental pitch C8 to be transmitted to output circuit 100.

As shown in FIG. 2, the top twelve keyer circuits also can transmit tone signals representing strike tones in response to strike signals at their S inputs. However, when the tone signal represents a strike tone, it is pitched one semitone below a power of two multiple of the pitch represented by the key producing the strike signal. For example, referring to FIG. 2, depression of either of the C# keys (i.e., keys 22 or 34) will produce a strike signal at input S of the C8 keyer circuit. As a result, a tone signal representing pitch C8 will be transmitted to output circuit 100. Assuming the keys are played through a 2-foot stop tab coupler, keyer signals also will be transmitted to the K input of the C#7 keyer circuit (FIG. 2) and the K input of the C#6 keyer circuit (not shown), so that tone signals representing fundamental pitches C#7 and C#6 also are transmitted to output circuit 100. Of course, the frequency of pitch C#8 is $2^1$ times the frequency of pitch C#7 and is $2^2$ times the frequency of pitch C#6. Thus, the strike tone (C8) is pitched one semitone below C#8 which has a frequency which is an integer power of two times the frequency of the associated fundamental pitches represented by the depressed C# keys. Since pitch C8 is nonharmonically related to pitches C#6 and C#7, it is capable of simulating a transient percussive strike tone associated with sustaining tones having pitches C#6 and C#7. This is an important feature which enables a single tone generator and a single group of keyer circuits to handle tone signals representing both sustaining tones and strike tones.

The other keyer circuits shown in FIG. 2 operate in an analogous manner which is summarized in TABLE 1:

TABLE 1

| Pitches of Fundamental Sustaining Tones Displaced by Octavess | Pitch of Corresponding Strike Tone |
|---|---|
| C4, C5, C6, C7, C8 | B7 |
| C#4, C#5, C#6, C#7 | C8 |
| D4, D5, D6, D7 | C#7 |
| D#4, D#5, D#6, D#7 | D7 |
| E4, E5, E6, E7 | D#7 |
| F4, F5, F6, F7 | E7 |
| F#4, F#5, F#6, F#7 | F7 |
| G4, G5, G6, G7 | F#7 |
| G#4, G#5, G#6, G#7 | G7 |
| A4, A5, A6, A7 | G#7 |
| A#4, A#5, A#6, A#7 | A7 |
| B4, B5, B6, B7 | A#7 |

It is believed that effective percussion simulation also can be achieved if the strike tone is placed one semitone above a power of 2 times the fundamental pitches of the tone signals used to simulate the sustaining tones. As can be observed from TABLE 1, a single tone signal having a single pitch (e.g., B7) can be used to simulate the strike tone associated with a plurality of sustaining tones having pitches displaced by octaves (e.g., C4, C5, C6, C7 and C8). This feature reduces the circuitry required and enables twelve keyer circuits capable of transmitting tone signals representing strike tones to service an entire keyboard. Since each of the pitches in the right hand column of TABLE 1 is nonharmonically related to the pitches in the left hand column of TABLE 1, a single tone signal (e.g., B7) can be used to simulate the strike tone for multiple sustaining tones (e.g., C4, C5, C6, C7 and C8).

Figure 3:
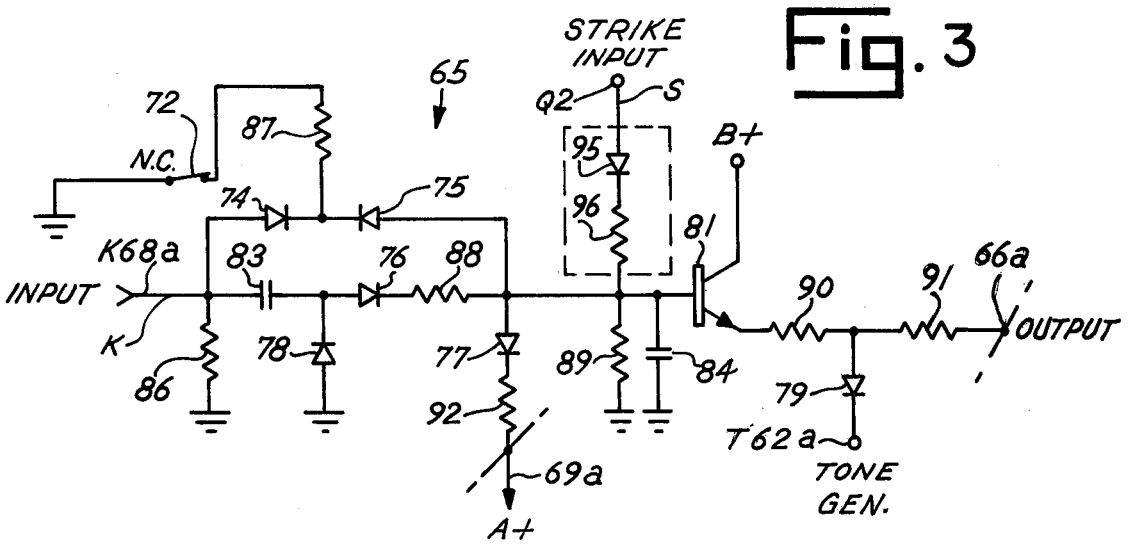
FIG. 3 is an electrical schematic diagram of a preferred form of keyer circuit which is capable of transmitting tone signals representing both sustaining tones having fundamental pitches and strike tones.

Referring to FIG. 3, a preferred form of the C8 keyer circuit shown in FIG. 2 (keyer circuit 65) comprises a tone generator input T62*a* for receiving a tone signal from tone generator 60. A keyer input K68*a* is adapted to receive a keyer signal (K), which switches between plus 22 volts and ground potential. In response to the keyer signal, the tone signal is transmitted from input T62*a* to an output 66*a* in a manner described later. A control voltage input 69*a* receives a positive control voltage A that controls the manner in which the tone signal is transmitted to output 66*a*. A strike input Q2 included within a bus 70 is used to receive a two millisecond strike pulse which causes a tone signal to be transmitted from tone generator input T62*a* to output 66*a* in a manner described later. A normally-closed switch 72 can be opened by a performer in order to increase the duration of a tone signal, thereby sustaining the sound resulting from a tone signal.

When the keyer circuit is used to transmit a tone signal representing a sustaining tone, the components which provide envelope shaping for the tone signal include diodes 74–79, a transistor 81, capacitors 83, 84 and resistors 86–92. When a tone signal is used to represent a strike tone, the envelope characteristics of the tone are shaped by additional components comprising a diode 95 and resistor 96.

Figure 6:
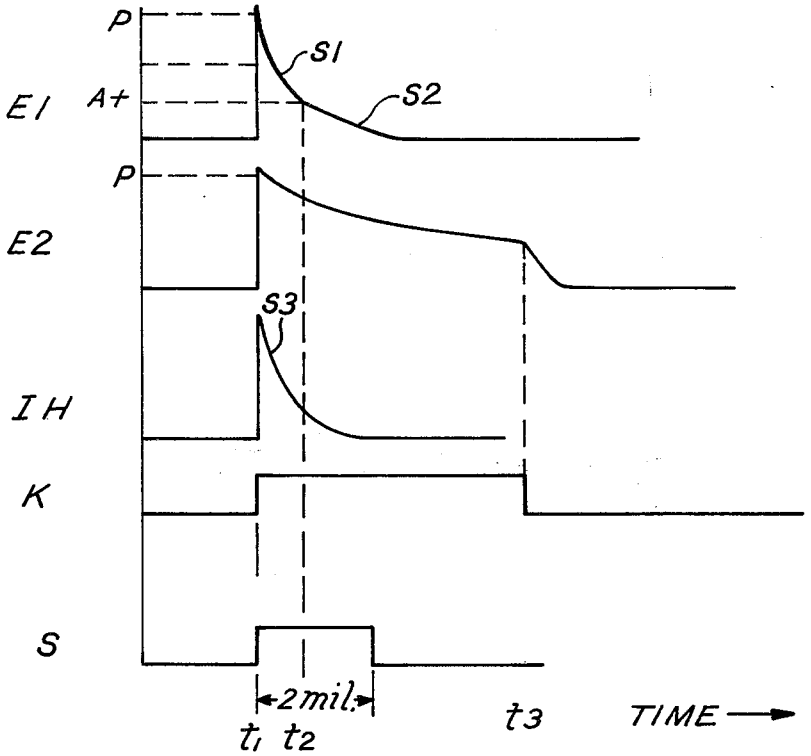
FIG. 6 illustrates waveforms generated by the circuitry shown in FIG. 3.

Referring to FIGS. 3 and 6, keyer circuit 65 operates in the following manner. Assuming a keyer signal K is raised to 22 volts at a time t1, and assuming terminal 69*a* is connected to a supply of A volts, a tone signal is transmitted from input terminal T62*a* to output terminal 66*a* with the envelope characteristics shown by waveform E1 in FIG. 6. The vertical axes opposite waveforms E1, E2 and IH in FIG. 6 represent the control voltage from the base of transistor 81 to ground. The time constant of the control voltage is different in sections S1 and S2 of waveform E1. The voltage decays exponentially at a rapid rate in section S1. However, after the voltage reaches the value A, diode 77 is reverse biased, so that the decay thereafter (in section S2) occurs more slowly. If the bias voltage on terminal 69*a* is increased to the peak value P of above, the decay time of the control voltage is substantially increased as shown in waveform E2. During the entire duration of keyer signal K, the rate of decay of waveform E2 remains substantially like the rate in section S2 of waveform E1. The control voltage can be configured in accordance with either waveform E1 or E2, depending on the effect desired by the player.

When a strike pulse (S) is received on input Q2 (FIG. 3), the control voltage rapidly rises to a peak P and then rapidly decays as shown in section S3 of waveform IH (FIG. 6). During the period of time from t1 to t2, the keyer circuit 65 transmits a tone signal from input T62*a* to putput 66*a* for use as a strike tone. The voltage illustrated by waveform IH provides the proper envelope shaping to simulate the strike tone. As shown by FIG. 6, a tone signal representing a sustaining tone (E2) and a tone signal representing a strike tone (IH) are transmitted to output circuit 100 at substantially the same time (e.g., t1) in response to the depression of a key. Tone signal E2 is transmitted in response to the strobe 2 pulse on conductor 121, and tone signal IH is transmitted in response to the strobe 1 pulse on conductor 120. The tone signal representing the sustaining tone is transmitted during a time period t1 to t3 and the tone signal representing the strike tone is transmitted during a time period t1 to t2 which is less than time period t1 to t3. This time differential adds realism to the simulation. Moreover, the transmission of waveform IH substantially ends at time t2 irrespective of how long the key is depressed beyond time t2.

It should be noted that keyer circuit 65 can be used either to produce a sustaining tone signal or a strike tone signal with the same basic circuitry. In order to provide for a strike tone signal, only a single diode 95 and a single resistor 96 need be added to the keyer circuit. This is an important feature which enables sustaining tone signals and strike tone signals to be keyed by the same keyer circuit.

Each of the keyer circuits in module 64 is substantially identical to keyer circuit 65 and can be understood from the foregoing description. Each of the keyer circuits has a separate output, and the combined outputs together form a bus 66 which transmits the resulting tone signals to output circuit 100.

Referring to FIG. 1, output circuit 100 includes a conventional filter 102 capable of altering the harmonic spectrum of the tone signals transmitted from the keyer circuits. By adjusting this filter, the timbre of the resulting sound is altered so that different types of percussion instruments can be simulated. The circuit also includes an audio amplifier 103 and a loudspeaker transducer 104 for creating audible tones.

Figure 7:
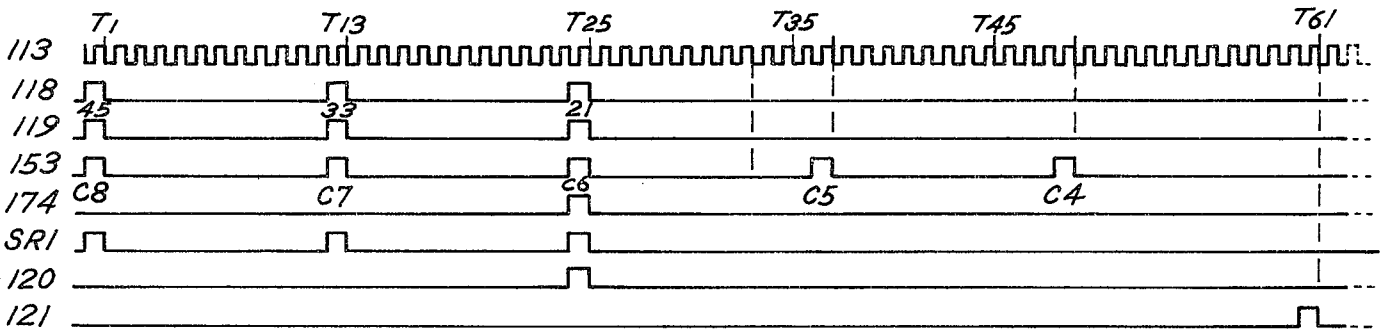
FIG. 7 is a timing diagram illustrating the signals generated on the like-numbered conductors shown in FIGS. 1, 4 and 5.

Control circuit 110 comprises a scan clock 112 which generates clock pulses over a conductor 113 of the type illustrated opposite waveform 113 in FIG. 7 at a rate of 65 K.Hz. The clock defines time slots which are used to determine the notes to be sounded in response to the depression of each of the keys. In each cycle of operation, the first 25 time slots represent the 25 keys of keyboard 10. Additional time slots also are generated during each cycle to represent the various notes which can be sounded in response to each key. In the present embodiment, each scan cycle includes approximately 61 time slots defined by the cycles of scan clock 112.

The time slots defined by clock 112 are used by a conventional key scan and timing circuit 115 in order to scan keyboard 10. The circuit communicates with the keyboard through a bus 117. Circuit 115 scans keyboard 10 once during each scan cycle and generates on conductors 118 and 119 serial data representing each of the keys depressed during that scan. The data on conductors 118 and 119 takes the form of a series of serial digital pulses. Each pulse is generated during a time slot representing a particular key which is depressed. The scanning takes place beginning with the key representing the highest pitch and continuing through the key representing the lowest pitch. In the case of keyboard 10, the scanning starts with key 45 and concludes with key 21. That is, keys 45–21 are represented by time slots T1–T25, respectively. For example, as shown opposite the number 118 in FIG. 7, a depression of keys 45, 33 and 21 results in production of pulses in time slots T1, T13 and T25, respectively.

Circuits such as key scan and timing circuit 115 are well known in the art and are described in U.S. Pat. Nos. 3,902,397 and 3,929,051, which are incorporated by reference. Circuit 115 also generates a strobe 1 timing pulse on a conductor 120 and a strobe 2 timing pulse on a conductor 121. The purpose of these pulses is described later.

Figure 4:
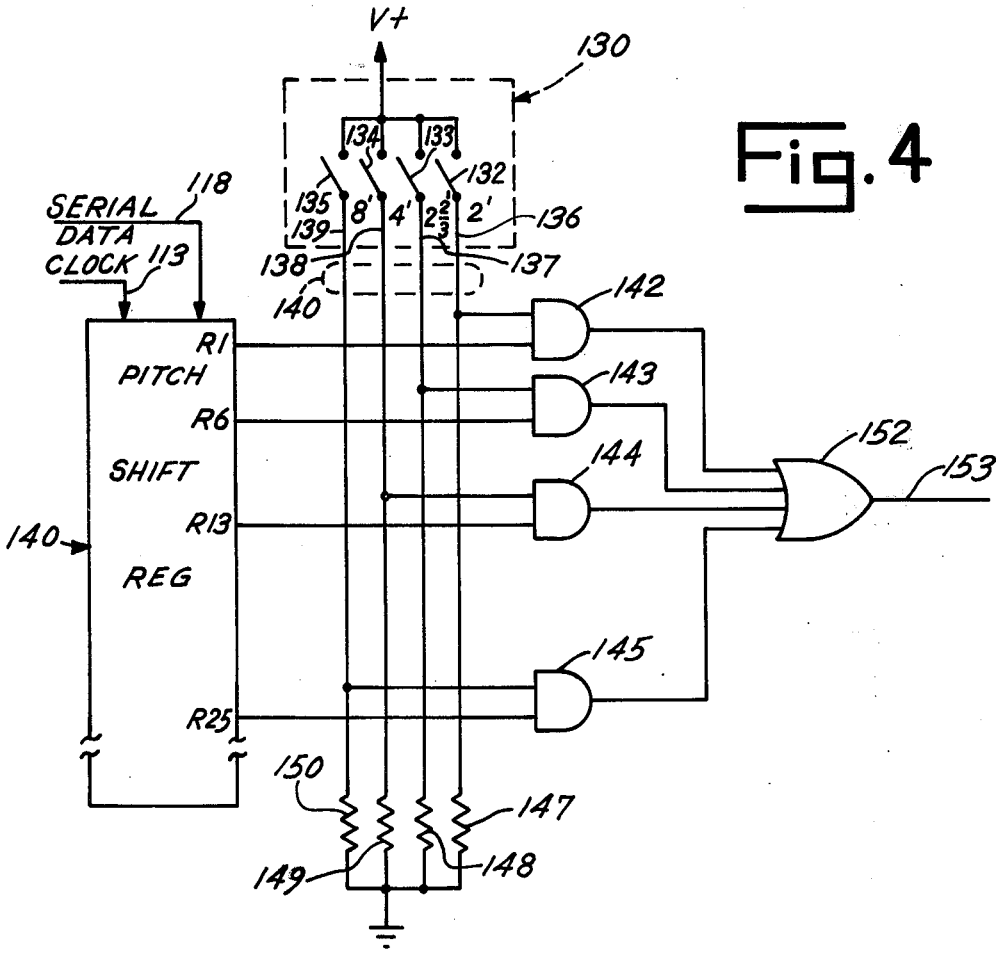
FIG. 4 is a logical block diagram of a preferred form of percussion determining circuit shown in FIG. 1.

Referring to FIG. 4, control circuit 110 also includes a percussion stop tab module 130 and a percussion pitch determining circuit 138:

Module 130 includes control switches 132–135 corresponding to 2-foot, 2⅔-foot, 4-foot and 8-foot couplers, respectfully. Additional circuitry (not shown) will close one or more of switches 132–135 in response to selection of a particular percussion stop tab by the performer. The switches are connected to conductors 136–139 which form a coupler signal bus 140.

Percussion pitch determining circuit 138 comprises a pitch shift register 140 having one output tap for each of the tones to be generated by the instrument. In the present example, only taps R1, R6, R13 and R25 are illustrated. These output taps represent delays of 0, 5, 12 and 24 time slots, respectively. The output taps of the shift register generate pitch representative signals which represent the various pitches or notes which can be produced by the instrument.

Circuit 138 also includes AND gates 142–145 which are biased by resistors 147–150. The outputs of the AND gates are conditioned by an OR gate 152 having an output conductor 153. AND gates 142–145 generate coded signals which determine each of the notes or pitches to be sounded in response to the depression of each of the keys on keyboard 10. This mode of operation is achieved by logically interrelating the pitch representative signals produced by shift register 140 with the coupler signals produced by control switches 132–135. Of course, those skilled in the art will recognize that other gates associated with each of the other pitches playable by the instrument may be connected in the appropriate manner to the output taps of shift register 140. However, based on the example of gates 142–145, the other gates can easily be connected in an appropriate manner.

Referring to FIG. 1, conductor 153 is connected to the input of a serial-to-parallel converter 155. Converter 155 converts the coded signals from gates 142–145 into parallel form on an output bus 68 which comprises one conductor for each of the pitches or notes to be sounded by the instrument. Each conductor of bus 68 is connected to a different one of the keyer circuits within module 64. Converter 155 uses the time slots defined by scan clock 112 in order to convert the keyer signals to parallel form. Briefly, each of the time slots defines a single note which can be produced by the instrument. If a pulse appears on conductor 153 in any particular time slot, converter 155 raises the conductor within bus 68 associated with the keyer designed to produce a pitch corresponding to that time slot to a logical one state. For example, if the depression of any key on the keyboard 10 indicates that pitch C8 is to be produced, a pulse appears on conductor 153 in time slot T1. The converter then raises to a logical one state (e.g., plus 22 volts), conductor **K68*a* which controls keyer 65 assigned to the production of the C8 pitch. Keyer 65 then transmits a tone generator signal from input T62*a* to output 66*a*** which is used as the sustaining tone of a percussive sound.

Figure 5:
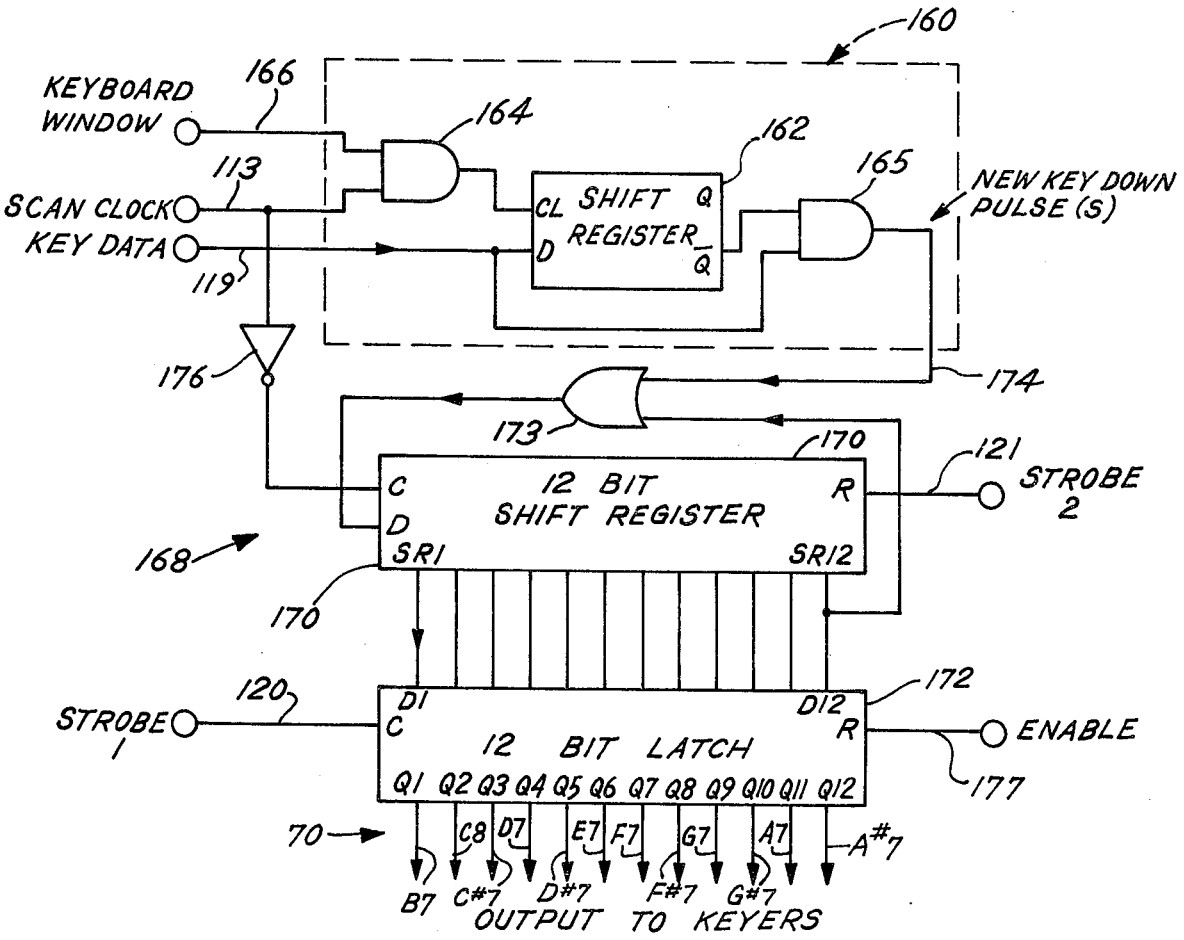
FIG. 5 is a logical block diagram of a preferred form of new key detector and key identifier shown in FIG. 1.

Referring to FIG. 5, circuit 110 also includes a new key detector 160 and a new key identifier 168. New key detector 160 comprises a 25-bit shift register 162, as well as AND gates 164, 165. Shift register 162 is clocked by the pulses received from scan clock 112 during time slots T1–T25. AND gate 164 enables the clock pulses generated during time slots T1–T25 to be transmitted to the shift register, but blocks the pulses during other period of time. This operation is achieved by means of a window logic pulse which creates a logical one level on conductor 166 during the first 25 time slots of each scan cycle. The window logic pulse can be derived from the clock pulses by conventional logic circuitry not shown.

New key identifier 168 comprises a 12-bit recirculating shift register 170, a 12-bit latch 172 having outputs Q1–Q12 which form bus 70, an OR gate 173 which is connected to AND gate 165 through a conductor 174, and an inverter 176. An enable input conductor 177 enables the latch to operate from a player-controlled switch whenever the player desires to use the percussion simulating capability. The Q1–Q12 outputs of latch 172 are connected to the strike (S) inputs of the FIG. 2 keyer circuits identified by pitch adjacent the Q1–Q12 outputs in FIG. 5.

In order to operate the circuitry described in FIG. 5, serial data from the keyboard is supplied on conductor 119 to the D input of shift register 162. The same data also is applied to one input of AND gate 165. Clock pulses are applied to the clock (CL) input of shift register 162 from AND gate 164 during time slots T1–T25 of each clock cycle. At the end of the first 25 time slots in each clock cycle, shift register 162 contains all the data pulses represented by the depressed keys of keyboard 10. At the beginning of the next keyboard scan, the data stored in shift register 162 from the previous scan is compared with the incoming keyboard data on conductor 119 bit-by-bit. The data from the previous scan is inverted because it is taken from the $\overline{Q}$ output of register 162. The incoming data updates the contents of shift register 162. Whenever a pulse appears on the incoming data in a time slot not occupied by a pulse in the previous scan, a new key pulse appears on conductor 174 at the output of AND gate 165. These new key pulses correspond to new keys depressed during the current scan cycle. The pulses may occupy any of the time slots from T1–T25.

The output of AND gate 165 is applied through an OR gate 173 to the D input of shift register 170. After time slot T25, shift register 170 contains pulses representing the note name (e.g., C or F#) of all of the new keys depressed during the current scan cycle. Register 170 requires only 12 bits since all octaves of the same note can be identified by the same note name.

The contents of register 170 are transferred to latch 172 during time slot T25 by means of a strobe 1 pulse on conductor 120. However, strobe I could also appear during time slot T37 or T49 and still achieve the same result. During time slot T61, shift register 170 is reset by means of a pulse on conductor 121.

The detailed operation of the circuitry will be explained by means of an example assuming that the percussion stop tab selected by the player results in the closing of control switches 132, 134 and 135, and assuming that the player depresses keys 21, 33 and 45 of keyboard 10. As illustrated in FIG. 7, depression of the keys results in pulses during time slots T1, T13 and T25 on conductors 118 and 119. Responsive to the operation of module 130 and shift register 140, pulses are produced on conductor 153 (FIG. 4) during time slots T1, T13, T25, T37 and T49. These time slots correspond to sustaning tones having fundamental notes or pitches C8, C7, C6, C5 and C4, respectively. Each of these pulses on conductor 153 is converted to parallel form by converter 155 and is used to activate a separate keyer circuit in module 64.

Assuming key 45 has just been depressed by the performer and had not been depressed during the previous scan cycle of clock 112, during time slot T1, a pulse representing key 45 is transmitted by AND gate 165 through OR gate 173 to shift register 170. As a result, output SR1 is switched to a logical one state during time slot T1. The pulse representing key 45 is recirculated through register 170 during the next 24 times slots until it again is present on output SR1 at time slot T25.

At time slot T25, a strobe one pulse is produced on conductor 120 which causes the bits stored in shift register 120 to be latched into latch 172. As a result, the Q1 output of latch 172 is raised to a logical one state in order to provide, a strike signal for the B7 keyer circuit within module 64 (FIG. 2) assigned to generate the tone signal corresponding to pitch B7. As noted in TABLE 1, B7 is the strike tone associated with each of the sustaining tones having fundamental pitches C4–C8. Since the key representing a sustaining tone having pitch C8 was newly depressed in the present scan cycle, the transmission of a pulse to the strike input of the B7 keyer circuit allows a tone signal representing a strike tone having a pitch B7 to be transmitted to the output circuit in accordance with the envelope characteristic described by waveshape IH in FIG. 5.

The provision of a new key detector is an important feature in the preferred embodiment because it enables a strike tone to be produced each time a key is struck. For example, even though a single keyer circuit is used in connection with the strike tone for all of the C pitches, the keyer circuit is activated with a strike signal each time a key corresponding to a C pitch is struck. Thus, in the present example, although the keyer circuit corresponding to pitch B7 produced a strike tone when keys 21 and 33 (corresponding to pitches C4–C6 and C5–C7) were first depressed, the keyer circuit was again activated by the depression of key 45 (corresponding to pitches C6–C8) in order to again produce a strike tone corresponding to those pitches.

As a result of this operation, the tone signals corresponding to pitches C8 and B7 are commenced at approximately the same instant of time (e.g., time tl in FIG. 6). The tone signal representing pitch C8 is continued for a duration determined by the envelope waveforms E1 or E2 shown in FIG. 6, whereas the tone signal representing pitch B7 is continued only for the duration indicated by the envelope waveform IH in FIG. 6. As a result, the C8 pitch is sounded for a longer period of time than the B7 pitch. This mode of operation enables the C8 pitch to represent the sustaining tone of a percussion instrument and enables the B7 pitch to represent the transient, aharmonic strike tone of the same percussion instrument.

The other keyer circuits operate in an analogous manner to provide a combination of sustaining tone and strike tone signals capable of simulating a natural percussion instrument which sounds at any of the fundamental pitches capable of being played by the instrument.

Those skilled in the art will recognize that the preferred embodiment described herein may be altered and modified without departing from the true spirit and scope of the invention as defined in the accompanying claims.

Although those skilled in the art will be able to practice the invention based on the foregoing description, additional information about details of the described circuitry can be obtained by reference to the Model H25-4/C500 Service Manual, published by Norlin Music, Inc. under Document No. 993-028063. This document is incorporated by reference.

What is claimed is:

1. In an electronic musical instrument, improved apparatus capable of simulating the sound of a natural percussion instrument, capable of emitting sustaining tones with different fundamental pitches and a strike tone nonharmonically related to each sustaining tone, said apparatus comprising:

a plurality of playable keys, each key representing a different fundamental pitch of a sustaining tone to be sounded by the electronic musical instrument;

tone signal generator means for generating a plurality of tone signals, each tone signal representing a different one of said fundamental pitches;

output means for converting the tone signals to audible tones; and control means responsive to the depression of any one of said keys for enabling a first one of said tone signals corresponding to a first fundamental pitch represented by said one key to be transmitted to the output means for a first time period and for enabling a second one of said tone signals corresponding to a pitch nonharmonically related to the first fundamental pitch to be simultaneously transmitted to the output means for a second time period less than the first time period, whereby the first one of said tone signals results in a sustaining tone and the second one of said tone signals results in a strike tone associated with the sustaining tone, so that the percussion instrument can be simulated.

2. Apparatus, as claimed in claim 1, wherein the keys represent semitones of the musical chromatic scale and wherein the control means comprises means for enabling the second one of said tone signals to represent a nonharmonic pitch displaced from an integer multiple of the first fundamental pitch by one chromatic semitone.

3. Apparatus, as claimed in claim 2, wherein the integer multiple is an integer power of 2.

4. Apparatus, as claimed in claim 3, wherein the nonharmonic pitch is displaced one semitone lower than an even integer multiple of the first fundamental pitch.

5. Apparatus as claimed in claim 1, and further comprising a separate keyer circuit for transmitting each tone signal representing a fundamental pitch to the output means, and wherein the control means comprises means for transmitting each tone signal representing a pitch nonharmonically related to a fundamental pitch to the output means through one of said keyer circuits.

6. Apparatus, as claimed in claim 5, wherein the control means comprises:

scan means for periodically scanning said keys during successive scan periods and for generating key data signals representing the playing state of each of said keys during said scan periods;

detection means for detecting the depression of a new one of said keys during a predetermined scan period, said new key being not depressed during a prior one of said scan periods; and means responsive to the detection of a new key for enabling a tone signal representing a pitch nonharmonically related to a fundamental pitch to be transmitted through one of said keyer circuits to the output means.

7. Apparatus, as claimed in claim 1, wherein the control means comprises means for commencing the transmission of the first and second one of the tone signals to the output means at substantially the same time and for enabling the second time period to be limited to a predetermined duration even if the one said key is held longer than the predetermined duration.

8. In an electronic musical instrument, improved apparatus capable of simulating the sound of a natural percussion instrument, capable of emitting sustaining tones with different fundamental pitches and a strike tone nonharmonically related to each sustaining tone, said apparatus comprising:

a plurality of playable keys, each key representing a different fundamental pitch of a sustaining tone to be sounded by the electronic musical instrument;

tone signal generator means for generating a plurality of tone signals, each tone signal representing a different one of said fundamental pitches;

output means for converting the tone signals to audible tones; and control means responsive to the depression of a plurality of said keys representing different fundamental pitches displaced by octaves for transmitting to the output means only a single tone signal representing a pitch nonharmonically related to said fundamental pitches displaced by octaves, the single tone signal being transmitted to the output means separately in response to the time-spaced depression of each of the keys representing the different fundamental pitches displaced by octaves, whereby a single tone signal represents the strike tones associated with the sustaining tones of the percussion instrument being simulated.

9. Apparatus, as claimed in claim 8, wherein the keys correspond to semitones of a musical chromatic scale and wherein the control means comprises means for enabling the nonharmonic pitch to be displaced by one semitone from an integer multiple of the fundamental pitches displaced by octaves.

10. Apparatus, as claimed in claim 9, wherein the integer multiple is an integer power of 2.

11. Apparatus, as claimed in claim 10, wherein the nonharmonic pitch is displaced one semitone lower than an even integer multiple of the fundamental pitches.

12. Apparatus as claimed in claim 8 and further comprising an independent keyer circuit for transmitting each tone signal representing a fundamental pitch to the output means, and wherein the control means comprises means for transmitting each tone signal representing a pitch nonharmonically related to a fundamental pitch to the output means through one of said keyer circuits.

13. Apparatus, as claimed in claim 12, wherein the control means comprises:

scan means for periodically scanning said keys during successive scan periods and for generating key data signals representing the playing state of each of said keys during said scan periods;

detection means for detecting the depression of a new one of said keys during a predetermined scan period, said new key being not depressed during a prior one of said scan periods; and means responsive to the detection of a new key for enabling a tone signal representing a pitch nonharmonically related to a fundamental pitch to be transmitted through one of said keyer circuits to the output means.

14. A method of electronically simulating the sound of a percussion instrument capable of emitting sustaining tones with fundamental pitches displaced by octaves and having strike tones nonharmonically related to the fundamental pitches, said method comprising the steps of:

generating a plurality of electrical tone signals having repetition rates representing a plurality of pitches displaced by octaves;

selecting any one of the sustaining tone signals for conversion to an audible sound;

generating only a single electrical strike tone signal having a repetition rate corresponding nonharmonically to all of the repetition rates of the sustaining tone signals;

converting the strike tone signal and the selected sustaining tone signal to sound waves; and decaying the strike tone signal faster than the selected sustaining tone signal, whereby the sound wave resulting from the strike tone signal simulates the nonharmonic strike tone of a percussion instrument and the sound resulting from the selected sustaining tone signal simulates the sustaining tone of a percussion instrument.

15. A method, as claimed in claim 14, wherein the repetition rate of the strike tone signal is displaced by one semitone from an integer multiple of the repetition rate of the selected sustaining tone signal.

16. A method, as claimed in claim 15, wherein the integer multiple is an integer power of 2.

17. A method, as claimed in claim 16, wherein the repetition rate of the strike tone signal is displaced one semitone lower than an integer power of 2 times the repetition rate of the selected sustaining tone signal.

* * * * *